US006110047A

United States Patent [19]

Lin

[11] Patent Number: 6,110,047

[45] Date of Patent: Aug. 29, 2000

[54] MOLD FOR FORMING A SCREW WITH AN AUGER TIP

[76] Inventor: Tsang-Yao Lin, No. 80, Alley 87, Lane 221, Sec. 1, Chung-Hwa Rd., Chu-Keng Village, Lung-Ching Hsiang, Taichung Hsien, Taiwan

[21] Appl. No.: 09/375,980

[22] Filed: Aug. 16, 1999

[51] Int. Cl.[7] ..... B21H 3/02

[52] U.S. Cl. ..... 470/65; 470/191; 470/207

[58] Field of Search ..... 470/8, 9, 11, 12, 470/16, 65, 183, 191, 207

[56] References Cited

U.S. PATENT DOCUMENTS

| | | | |
|---|---|---|---|
| 4,150,451 | 4/1979 | Skierski | 470/65 |
| 5,014,540 | 5/1991 | Ferrante | 470/65 |
| 5,980,390 | 11/1999 | Ferrante | 470/65 |

FOREIGN PATENT DOCUMENTS

| | | | |
|---|---|---|---|
| 414973 | 3/1991 | European Pat. Off. | 470/65 |
| 1-75138 | 3/1989 | Japan | 470/65 |

*Primary Examiner*—Ed Tolan
*Attorney, Agent, or Firm*—Dellett and Walters

[57] ABSTRACT

A mold for forming an auger tip on a screw is disclosed. The mold has a pair of symmetrical secondary molds each has a base mold (50), a first mold (30) detachably received in the base mold (50) and a second mold (40) detachably received in the first mold (30) detachably received in the first mold (30) and having a forming edge (41) formed thereon so as to form the auger tip on the screw by colliding two forming edges together. Therefore, when the forming edge (41) is damaged and replacement thereof is necessary, a user is able to replace only the second mold to reduce the cost.

1 Claim, 4 Drawing Sheets

MOLD FOR FORMING A SCREW WITH AN AUGER TIP

BACKGROUND OF THE INVENTION

1. Field of the Invention

The present invention relates to a mold for forming a screw, and more particularly to a mold for forming a screw with an auger tip.

2. Description of Related Art

Conventionally, there are two steps to form a screw with an auger tip; the first step is to use a threading device to form threads on a material, the other is to use a mold press to form the auger tip on the screw. The mold press has two symmetrical parts operatively aligned with each other. When the threads is formed on the periphery of the material, the material is transported to the mold press to continuously form the auger tip. The mold press, as stated earlier, has two symmetrical parts each one of which comprises a first mold (50) and a second mold (40) detachably received in the first mold (50). The first mold (50) has a U shape cutout (51) and a first screw hole (52) defined to communicate with the U shape cutout (51). The second mold (40) forms thereon a forming edge (41), a conical recess (42) defined in a side thereof and a stop (43) formed on a face corresponding to that of the forming edge (41). The second mold (40) is able to be snugly fitted into the U shape cutout (51), whereby a first screw (53) is able to be threadingly inserted through the screw hole (52) and into the conical recess (42) of the second mold (40) to securely position the second mold (40) with respect to the first mold (50). It is known that after the first mold (50) and the second mold (40) are assembled to become a half of the mold press, the user is able to use two halves of the assembled first and second molds (40,50) to form an auger tip on a screw. Because the forming of the auger tip on the screw needs a pair of assembled first and second molds (40,50) to oppositely collide with each other, so as that two forming edges (41) are able to form an auger tip of the screw. After continuous collision between two forming edges (41) to form the auger tip on the screw, damage to the forming edge (41) is inevitable, although the provision of the stop (43) is to prolong the life span of the mold press. Therefore, a replacement of the second mold (40) is required. Due to the concern of continuous collision between two assembled first and second molds (40,50), the second mold (40) is made of a material of high strength and hardness, such as tungsten-carbide. As well known in the art, the tungsten is quite expensive, thus the replacement of the second mold (40) will increase the cost and will also cause an environment problem. Furthermore, when forming an auger tip of different type on the screw, the user will have to replace the second mold (40) altogether, which will certainly increase the cost.

The present invention aims to provide an improved mold to form an auger tip on a screw so as to mitigate and/or obviate the aforementioned problems.

SUMMARY OF THE INVENTION

It is therefore an objective of the invention to provide an improved mold for forming an auger tip on a screw. The mold has a pair of symmetrical secondary molds each comprising a base mold, a first mold detachably secured in the base mold and a second mold detachably received in the first mold. With such an arrangement, the second mold is able to be replaced when damaged. Because the molding of the auger tip on the screw is by the collision of two symmetrical secondary molds, and the colliding parts therebetween are the second molds of each of the secondary molds, such that when the second molds are damaged during the molding process, the user is able to replace only the second mold instead of the first and the second molds altogether in the prior art, which the cost to manufacture the mold can be reduced dramatically.

Other features and characteristics would be better understood with the reference to the detailed description of the preferred embodiment and the brief description of the drawings.

DETAILED DESCRIPTION OF THE PREFERRED EMBODIMENT

Figure 1:
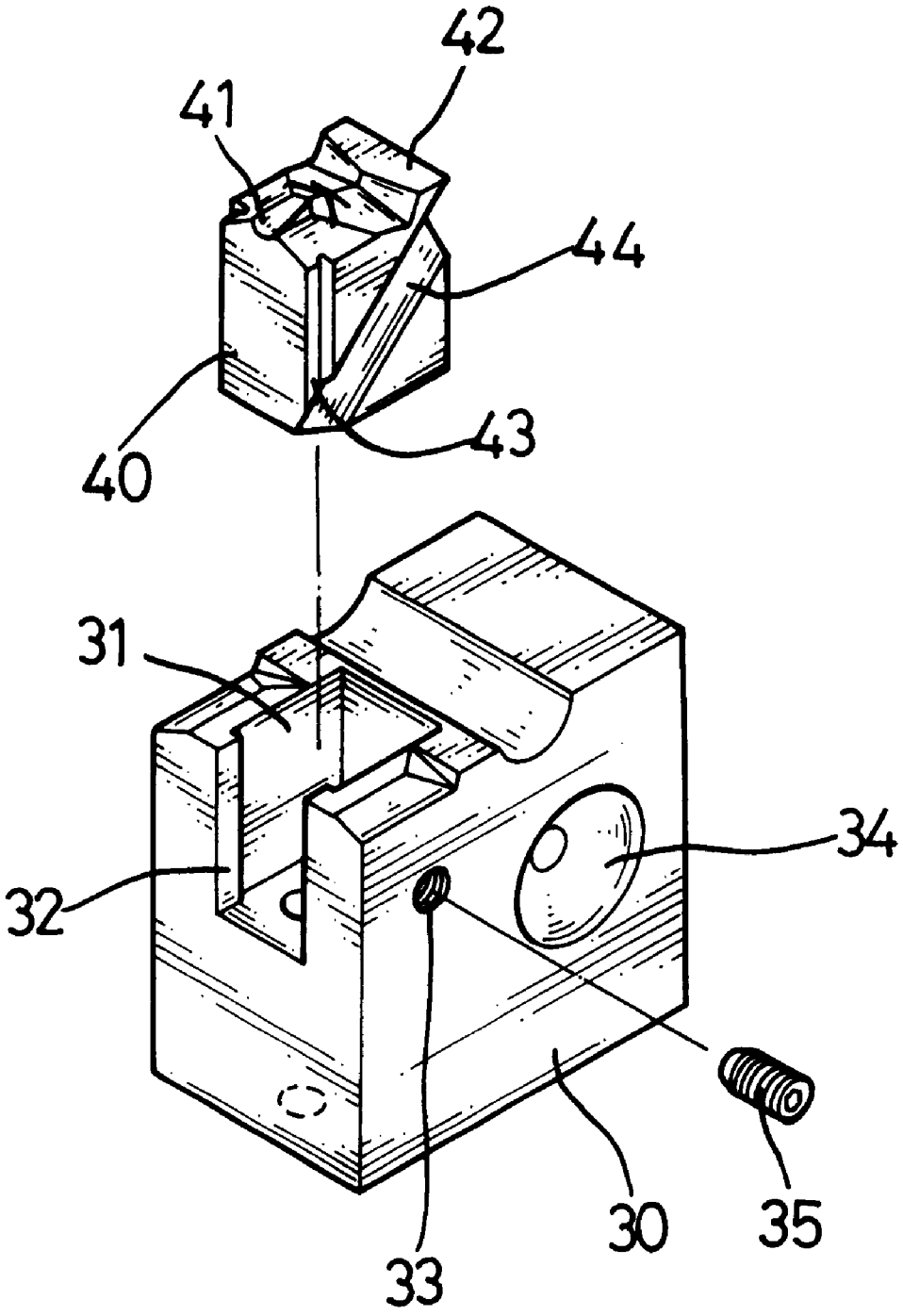
FIG. 1 is an exploded perspective view showing the structure of the invention.
Figure 2:
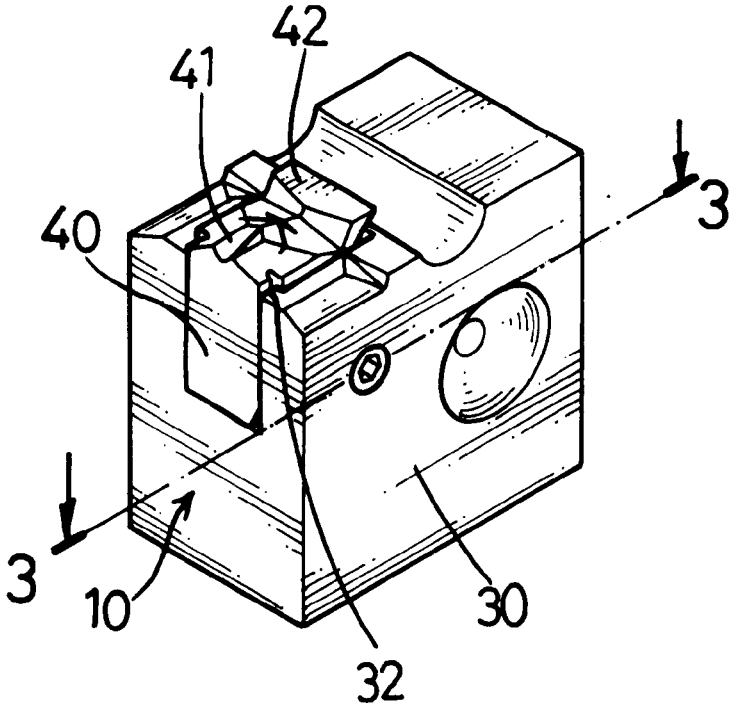
FIG. 2 is a perspective view of the mold of the invention.
Figure 5:
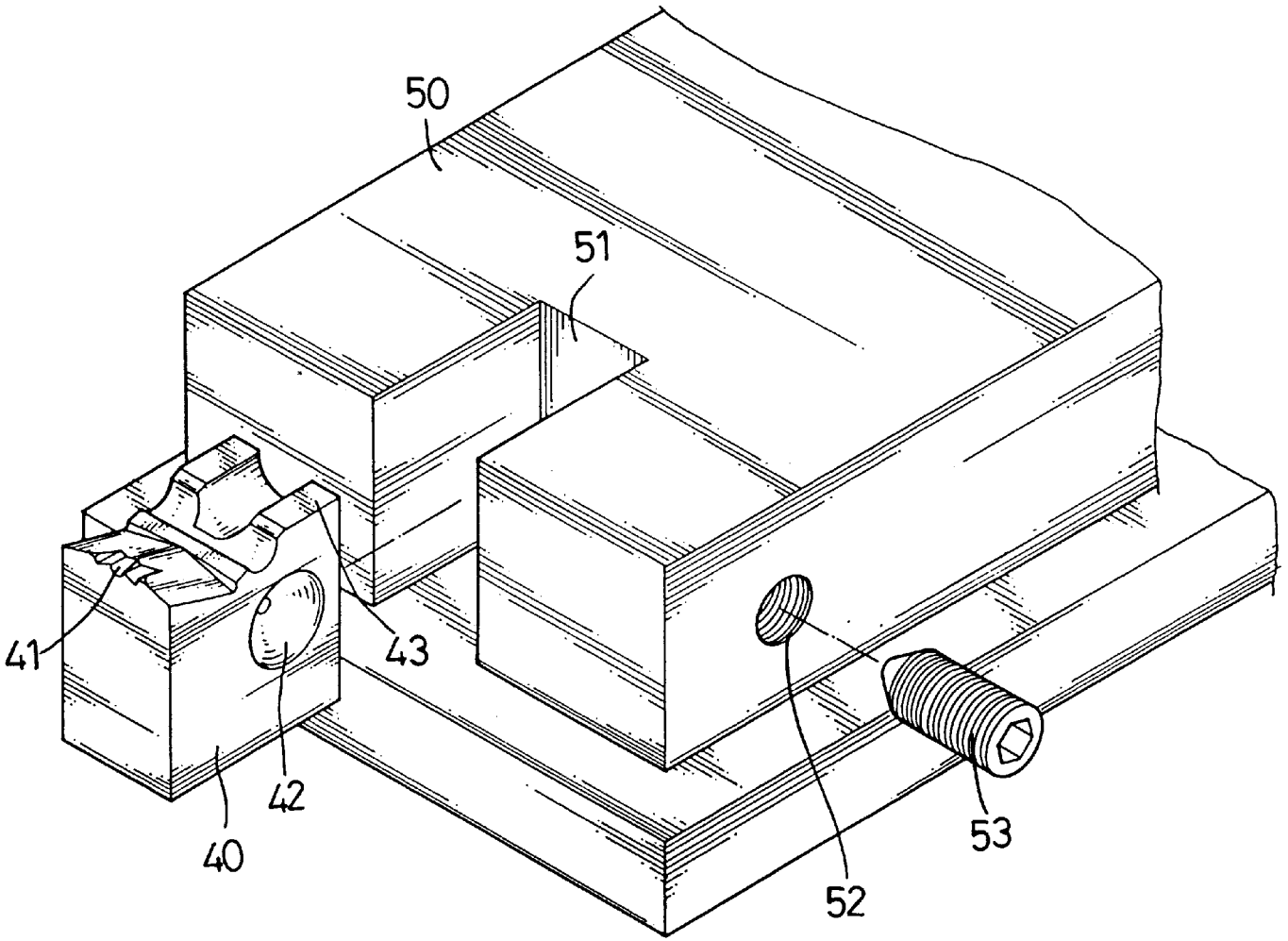
FIG. 5 PRIOR ART
FIG. 5 is an exploded view showing the structure of a conventional mold for forming an auger tip on a screw.

It is to be noted from FIGS. 1 and 2 that the mold for forming an auger tip on a screw has a pair of symmetrical secondary molds each continuously collided with each other and each comprising a base mold (as shown in FIG. 5 and having the same structure, thus designated with the same reference numeral), a first mold (30) detachably received in the base mold (50) and having a substantially rectangular cutout (31) defined therein, a pair of tracks (32) formed on opposite sides defining the cutout (31), a second screw hole (33) defined to communicate with the cutout (31) and a conical recess (34) defined to align with the first screw hole (52) of the base mold (50) thereby allowing the first screw (53) to be inserted through the first screw hole (52) to abut the first mold (30) at the bottom face defining the conical recess (34) and a second mold (40) having a forming edge (41), a stop (42) formed on a top thereof, a pair of rails (43) formed to correspond to the pair of tracks (32) of the first mold (30) and a V-shaped path (44) defined to correspond to the second screw hole (33). When the second mold (40) is received in the first mold (30), a second screw (35) is able to be inserted through the second screw hole (33) and into the V-shaped path (44) so as to securely position the second mold (40) in the first mold (30).

Figure 3:
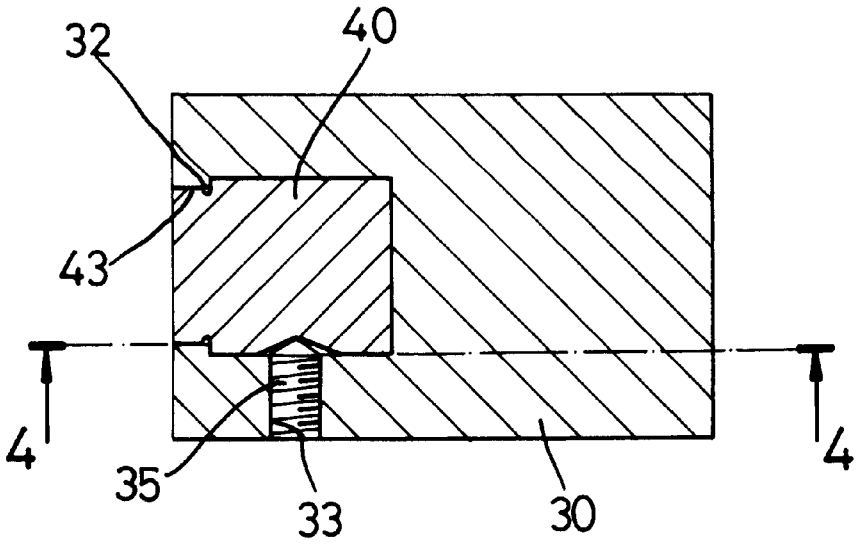
FIG. 3 is a cross sectional view of FIG. 1 by taking the line 3—3 of FIG. 2.
Figure 4:
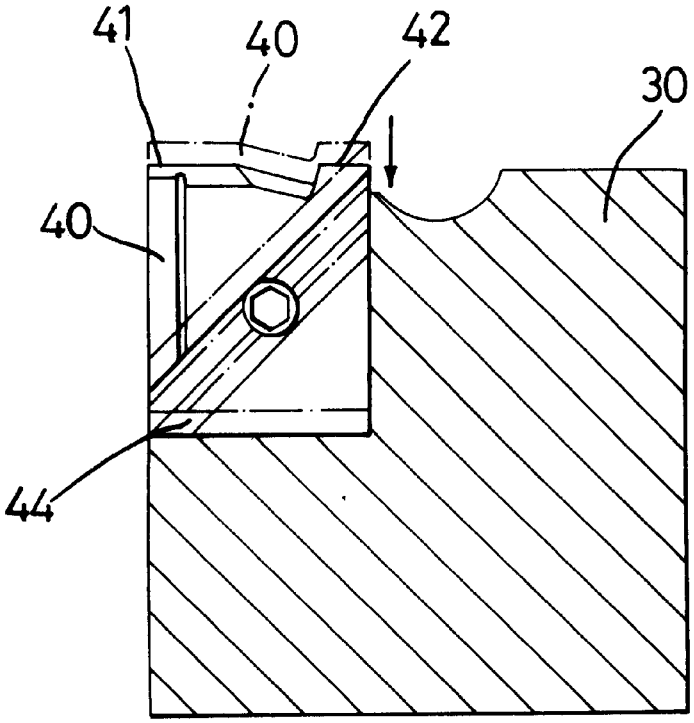
FIG. 4 is a cross sectional view of FIG. 1 by taking the line 4—4 of FIG. 3.

Referring to FIGS. 3 and 4, when the second screw (35) is inserted through the second screw hole (33), the tip of the second screw (35) will be abutted to the bottom face defining the conical recess (34) and the second mold (40) is securely received in the cutout (32) of the first mold (30).

With such an arrangement, the forming edge (41) is formed on the second mold (40) to form an auger tip on a screw by colliding two forming edges (41) together, such that even when the forming edge (41) is damaged from the continuous collision with another second mold (40), the user can only replace the second mold (40) without replacing the entire first mold (30) and the second mold (40) as the conventional manner.

From the above description, it is noted that the invention has the following advantages:

1. Because only the second mold (40) is made of expensive metal, the material cost of the mold of the invention (10) is reduced;
2. When the forming edge (41) of the second mold (40) is damaged due to the collision with the symmetrical second mold (40), the user is able to replace the second mold (40) easily by removing the second screw (35) to eliminate the connection between the first mold (30) and the second mold (40). Thus, the second mold (40) is able to slide out from the cutout (32) to be replaced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mold for forming an auger tip on a screw, the mold comprising a pair of symmetrical secondary molds each having:

a base mold (50) defining therein a U-shaped cutout (51) and a first hole (52) defined to communicate with said U-shaped cutout (51);

a first mold (30) detachably received in said U-shaped cutout (51) of said base mold (50), said first mold (30) including a substantially rectangular cutout (31) defined therein, a pair of tracks (32) formed on opposite ends defining said cutout (31), a second screw hole (33) defined to communicate with said cutout (31) and a conical recess (34) defined to align with said first screw hole (52) of said base mold (50) thereby allowing a first screw (53) to be inserted through said first screw hole (52) to abut said first mold (30) at a bottom face defining said conical recess (34);

a pair of rails (43) formed to correspond to said pair of tracks (32) of said first mold (30) and a V-shaped path (44) defined to correspond to said second screw hole (33); and a second screw (35) provided to be inserted through said second hole (33) and into said V-shaped path (44) after a second mold (40) is received in said first mold (30).

* * * * *